US006930505B2

(12) United States Patent
Taguchi et al.

(10) Patent No.: US 6,930,505 B2
(45) Date of Patent: Aug. 16, 2005

(54) INSPECTION METHOD AND APPARATUS FOR EL ARRAY SUBSTRATE

(75) Inventors: Tomoyuki Taguchi, Kusatsu (JP); Atsuto Ohta, Kyoto (JP)

(73) Assignee: International Business Machines Corporation, Armonk, NY (US)

( * ) Notice: Subject to any disclaimer, the term of this patent is extended or adjusted under 35 U.S.C. 154(b) by 312 days.

(21) Appl. No.: 10/249,246

(22) Filed: Mar. 26, 2003

(65) Prior Publication Data

US 2003/0187597 A1 Oct. 2, 2003

(30) Foreign Application Priority Data

Mar. 29, 2002 (JP) ..... 2002-095324

(51) Int. Cl.[7] ..... G01R 31/00
(52) U.S. Cl. ..... 324/770
(58) Field of Search ..... 324/500–537, 324/765–770; 349/190–192; 438/14–18; 714/25–33

(56) References Cited

U.S. PATENT DOCUMENTS 4,984,202 A * 1/1991 Kawahara et al. ..... 365/177
5,428,300 A * 6/1995 Takahashi et al. ..... 324/770
5,608,558 A * 3/1997 Katsumi ..... 324/770
5,994,916 A * 11/1999 Hayashi ..... 324/770
2003/0184334 A1 * 10/2003 Matsunaga et al. ..... 324/765

FOREIGN PATENT DOCUMENTS

JP 2001195033 A * 7/2001 ..... G01R/31/02
JP 2001195034 A * 7/2001 ..... G01R/31/02
JP PUPA 2002-032035 1/2002
JP PUPA 2003-228299 8/2003

OTHER PUBLICATIONS

English Abstract PUPA 2002–032035, Jan. 31, 2002, Japan.
English Abstract PUPA 2003–228299, Aug, 15, 2003, Japan.

* cited by examiner

*Primary Examiner*—Jermele M. Hollington
(74) *Attorney, Agent, or Firm*—Joseph P. Abate

(57) ABSTRACT

To provide an inspection method for an EL array substrate that can detect a failure on the EL array substrate before assembling an EL panel. By giving a prescribed potential to a data line 6 to turn on a switching transistor 4 for a prescribed time, a holding capacitor 3 and a parasitic capacitor 8 are charged. By turning on again the switching transistor 4 after a lapse of a prescribed time from turning-off of the switching transistor 4 and by connecting the data line 6 to an integrator 10, the holding capacitor 3 and the parasitic capacitor 8 are discharged, and a discharged amount of charge is detected by the integrator 10. Based on this amount of charge, a failure on an EL array substrate is detected before assembling an EL panel.

20 Claims, 13 Drawing Sheets

INSPECTION METHOD AND APPARATUS FOR EL ARRAY SUBSTRATE

BACKGROUND OF INVENTION

The present invention relates to an inspection method and apparatus for an EL (ElectroLuminescence) array substrate, and more specifically, relates to an inspection method and apparatus for an EL array substrate comprising a drive transistor having the drain connected to one of electrodes of an EL element, a holding capacitor connected to the gate of the drive transistor, a parasitic capacitor formed between the one electrode of the EL element and the gate of the drive transistor, and a switching transistor having the drain connected to the gate of the drive transistor.

FIG. 20 is a circuit diagram showing a configuration of one pixel of an organic EL panel. This organic EL panel is of the so-called voltage writing type, and comprises an organic EL element 1, a drive transistor 2, a holding capacitor 3, a switching transistor 4, a gate line 5 and a data line 6.

When the switching transistor 4 turns on, charge is introduced from the data line 6 so that the holding capacitor 3 is charged. When the switching transistor 4 turns off, writing of a voltage into the holding capacitor 3 is finished and the holding capacitor 3 holds the written voltage. The gate potential of the drive transistor 2 upon the termination of the voltage writing is determined based on the amount of charge charged in the holding capacitor 3. Current that flows through the organic EL element 1 is controlled depending on this gate potential, thereby to control the luminance of the organic EL element 1.

During the fabrication process of such an organic EL panel, ON/OFF failures of the drive transistor 2 and the switching transistor 4 and open/short-circuit failures of the holding capacitor 3 are inspected. This inspection, however, is carried out in the lighting inspection process of the organic EL element 1 after the organic EL panel has been assembled. Accordingly, even if a failure is generated on an organic EL array substrate before the organic EL element 1 is formed thereon, i.e. before the organic EL panel has been assembled, that failure is only detected after the organic EL panel has been assembled. Among failures to be detected, there are those failures that can be put in order on the substrate before assembling, but can not be mended on the panel after assembling. As a result, there arises a problem that the assembling cost becomes vain.

SUMMARY OF INVENTION

It is an object of the present invention to provide an inspection method and apparatus for an EL array substrate, wherein a failure on the EL array substrate can be detected before assembling an EL panel.

An inspection method for an EL array substrate according to the present invention comprises a writing step of giving a prescribed potential to a drain of a switching transistor, and turning on the switching transistor for a prescribed write time, a reading step of, after a lapse of a prescribed time from turning-off of the switching transistor, turning on again the switching transistor, and connecting the drain of the switching transistor to a charge amount measuring device, and a detection step of detecting a failure on the EL array substrate based on an output of the charge amount measuring device.

An inspection apparatus for an EL array substrate according to the present invention comprises writing means, reading means and detection means. The writing means gives a prescribed potential to a drain of a switching transistor and turns on the switching transistor for a prescribed write time. After a lapse of a prescribed time from turning-off of the switching transistor, the reading means turns on again the switching transistor and connects the drain of the switching transistor to a charge amount measuring device. The detection means detects a failure on the EL array substrate based on an output of the charge amount measuring device. As the charge amount measuring device, an integrator, a differentiator or the like is used.

When the switching transistor is held on for a prescribed write time, a holing capacitor and a parasitic capacitor of the EL array substrate are charged. When the switching transistor is turned on again after a lapse of a prescribed time from turning-off of the switching transistor and the drain of the switching transistor is connected to the charge amount measuring device, the holding capacitor and the parasitic capacitor are discharged and the discharged charge amount is detected by the charge amount measuring device.

Accordingly, based on the charge amount outputted from the charge amount measuring device, a failure on the EL array substrate can be detected before assembling an EL panel. Even such a failure that can not be mended on the EL panel after assembling can be mended on the EL array substrate. Therefore, the production efficiency can be improved and the assembling cost can be prevented from becoming vain.

Hereinbelow, preferred embodiments of the present invention will be described in detail with reference to the drawings. In the drawings, the same or corresponding portions are assigned the same reference symbols so as to take advantage of explanation therefor.

DETAILED DESCRIPTION

First Embodiment

Configuration

Figure 1:
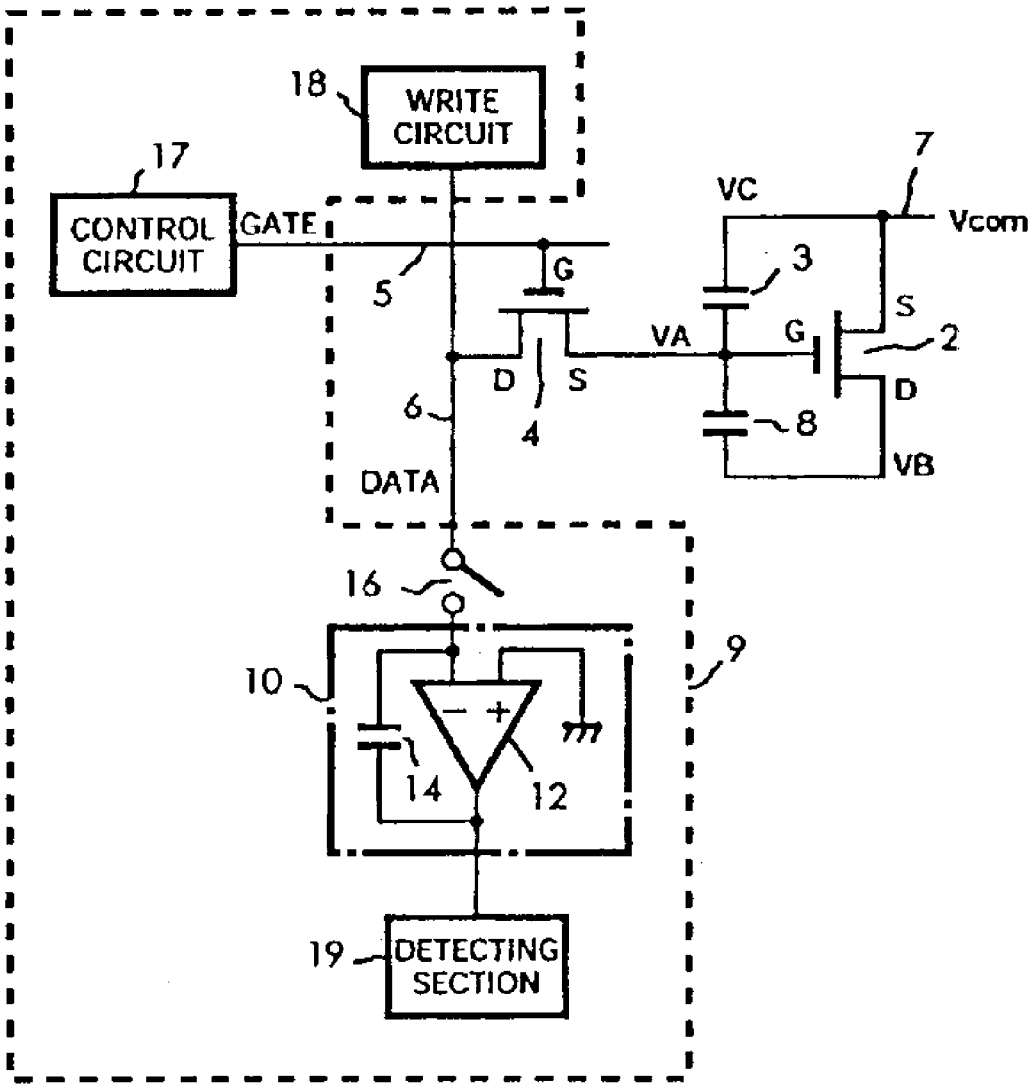
FIG. 1 is a circuit diagram showing a configuration of one pixel of an EL array substrate that is an inspection object in each of inspection methods according to first and second preferred embodiments of the present invention, and a configuration of an inspection apparatus for inspecting it.

FIG. 1 is a circuit diagram showing a configuration of one pixel of an organic EL array substrate before assembling an organic EL panel and a configuration of an inspection apparatus for inspecting it. This organic EL array substrate comprises a drive transistor 2, a holding capacitor 3, a switching transistor 4, a gate line 5 and a data line 6.

For simplification, FIG. 1 shows only one pixel. On an actual organic EL array substrate, however, pixels are arranged in a matrix. The gates of the switching transistors of the pixels in each row are commonly connected to a corresponding gate line, while the drains of the switching transistors of the pixels in each column are commonly connected to a corresponding data line. By driving the selected gate line and data line, the desired pixel can be operated.

The drive transistor 2 is in the form of an N-channel thin film transistor (TFT) and has the source connected to a common line 7. The holding capacitor 3 is connected between the gate of the drive transistor 2 and the common line 7. The switching transistor 4 is also in the form of an N-channel thin film transistor (TFT) and has the source connected to the gate of the drive transistor 2, the gate connected to the gate line 5, and the drain connected to the data line 6.

Figure 20:
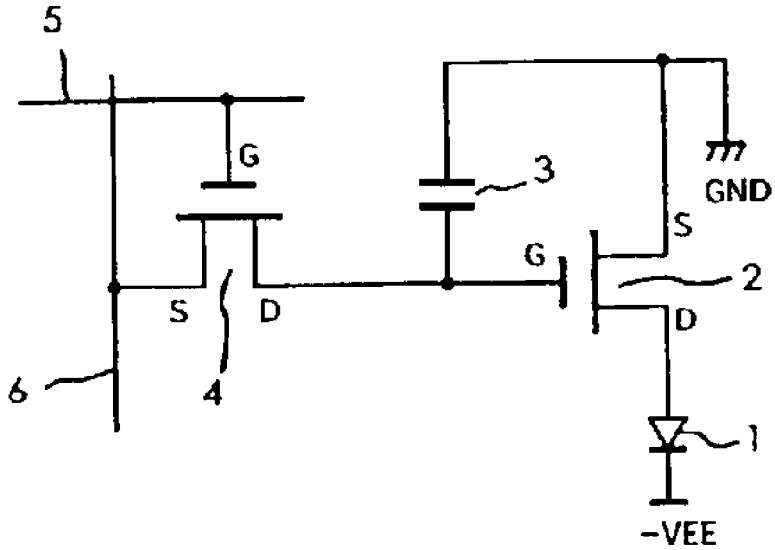
FIG. 20 is a circuit diagram showing a configuration of one pixel of an organic EL panel.

On the organic EL array substrate shown in FIG. 1, the organic EL element 1 and its cathode shown in FIG. 20 are not formed. On the other hand, an ITO (Indium Tin Oxide) film (not shown) serving as its anode is formed. The drain of the drive transistor 2 is connected to this ITO film, but in an open-circuit state. Inasmuch as the ITO film overlaps the gate of the drive transistor 2 due to the configuration, a parasitic capacitor 8 is formed therebetween.

For inspecting the organic EL array substrate, an inspection apparatus 9 is connected. The inspection apparatus 9 comprises an integrator 10, a switching element 16, a control circuit 17, a write circuit 18 and a detecting section 19.

The integrator 10 comprises a differential amplifier 12 and an integral capacitance 14. The data line 6 of the organic EL array substrate is connected to an inverted input terminal of the differential amplifier 12 via the switching element 16. The control circuit 17 controls a potential GATE of the gate line 5 according to a later-described method. The write circuit 18 gives a prescribed potential DATA to the data line 6 according to a later-described method. The detecting section 19 detects a failure on the EL array substrate based on an output of the integrator 10 according to a later-described method.

In the actual inspection, the integrator 10 is connected to each data line 6, the control circuit 17 is connected to all gate lines 5, and the write circuit 18 is connected to all data lines 6.

Inspection Method

Now, an inspection method for the organic EL array substrate will be described. This inspection method comprises a mode of writing charge into the holding capacitor 3 and the parasitic capacitor 8, a mode of reading the written charge, and a mode of detecting a failure based on the read charge.

Write Mode

Figure 2:
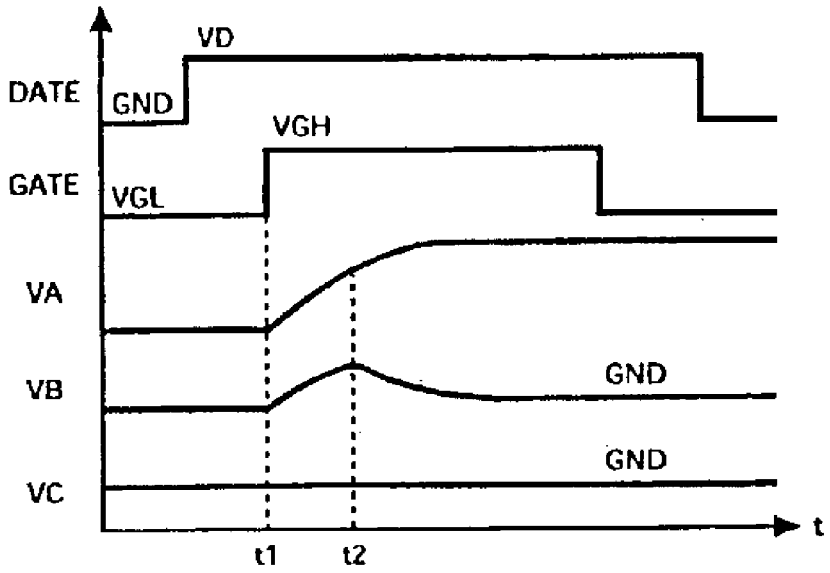
FIG. 2 is a timing chart showing operations in a write mode of the inspection method according to the first preferred embodiment of the present invention.
Figure 3:
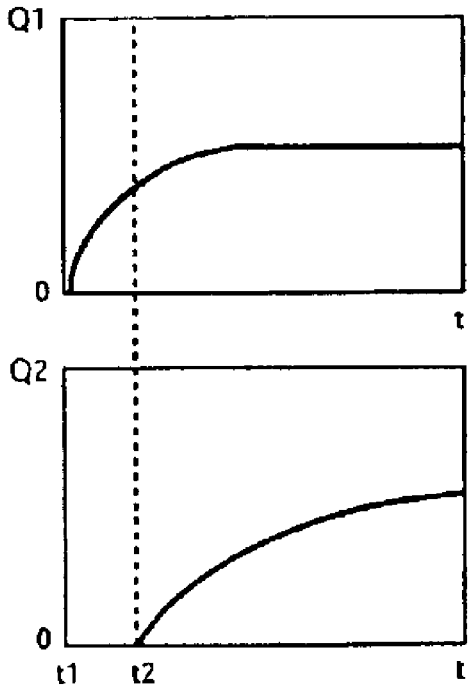
FIG. 3 is a diagram showing variations in amount of charge of a holding capacitor and a parasitic capacitor in FIG. 1 during the write mode shown in FIG. 2.

FIG. 2 is a timing chart showing operations in the write mode. First, the write circuit 18 raises the potential DATA of the data line 6 from a ground potential GND to a driving potential VD (approximately +15V), then the control circuit 17 raises the potential GATE of the gate line 5 from a low potential VGL (approximately −5V) to a high potential VGH (approximately +20V) at time instant t1. This causes the switching transistor 4 to turn on so that a potential VA starts to rise toward the driving potential VD. Following it, a charge amount Q1 of the holding capacitor 3 also increases as shown in FIG. 3.

In this event, since the drive transistor 2 is off, the drain of the drive transistor 2 is in a floating state. Therefore, as shown in FIG. 2, following the rise of the potential VA, a potential VB rises due to coupling of the parasitic capacitor 8. However, since the parasitic capacitor 8 is not charged, a charge amount Q2 of the parasitic capacitor 8 does not increase.

When the potential VA exceeds a threshold value of the drive transistor 2 at time instant t2, the drive transistor 2 turns on so that the potential VB drops toward a common potential Vcom (GND). Following it, the charge amount Q2 of the parasitic capacitor 8 increases. However, inasmuch as the ON-state resistance of the drive transistor 2 is relatively high, the charge amount Q2 increases more gradually than the charge amount Q1.

Subsequently, prior to saturation of the holding capacitor 3 and the parasitic capacitor 8, the control circuit 17 returns the potential GATE of the gate line 5 to the low potential VGL. This causes the switching transistor to turn off. Subsequently, the write circuit 18 returns the potential DATA of the data line 6 to the ground potential GND.

Hereinafter, a time for which the potential GATE of the gate line 5 is held at the high potential VGH to keep the switching transistor 4 turned on will be referred to as "write time".

Charge amounts Qw1 and Qw2 charged in the holding capacitor 3 and the parasitic capacitor 8 according to the foregoing writing are expressed by the following equations (1) and (2), respectively.

$$Qw1=C1(Vwa-Vwc) \quad (1)$$

$$Qw2=C2(Vwa-Vwb) \quad (2)$$

In the equations (1) and (2), C1 represents a capacitance of the holding capacitor 3, C2 a capacitance of the parasitic capacitor 8, Vwa the potential VA (=VD) upon the termination of the writing, Vwb the potential VB upon the termination of the writing, and Vwc the potential VC (=Vcom) upon the termination of the writing.

Read Mode

Then, after standing for a prescribed time the organic EL array substrate having been subjected to the writing of the charge, reading of the charge is carried out. When implementing the reading of the charge, the switching element 16 shown in FIG. 1 is turned on so as to connect the data line 6 to the inverted input terminal of the differential amplifier 12.

Figure 4:
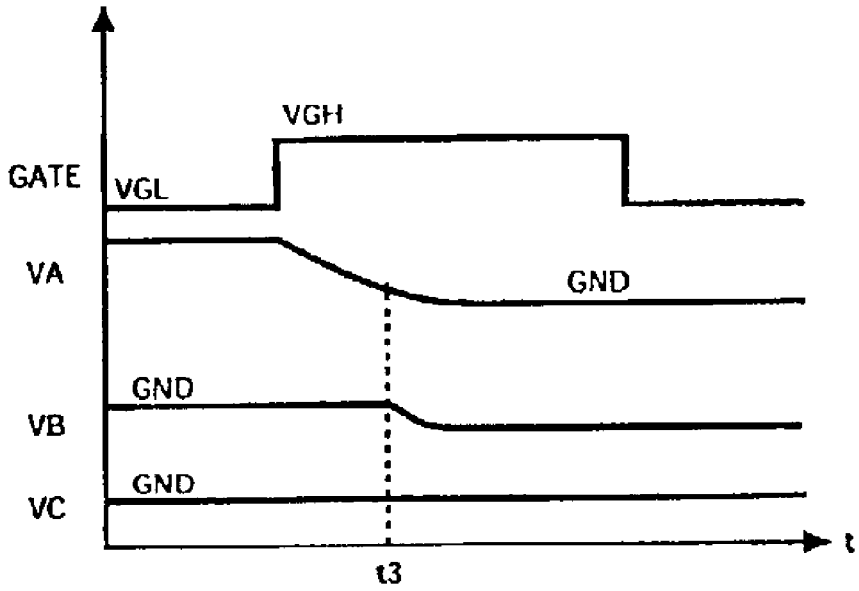
FIG. 4 is a timing chart showing operations in a read mode of the inspection method according to the first preferred embodiment of the present invention.
Figure 5:
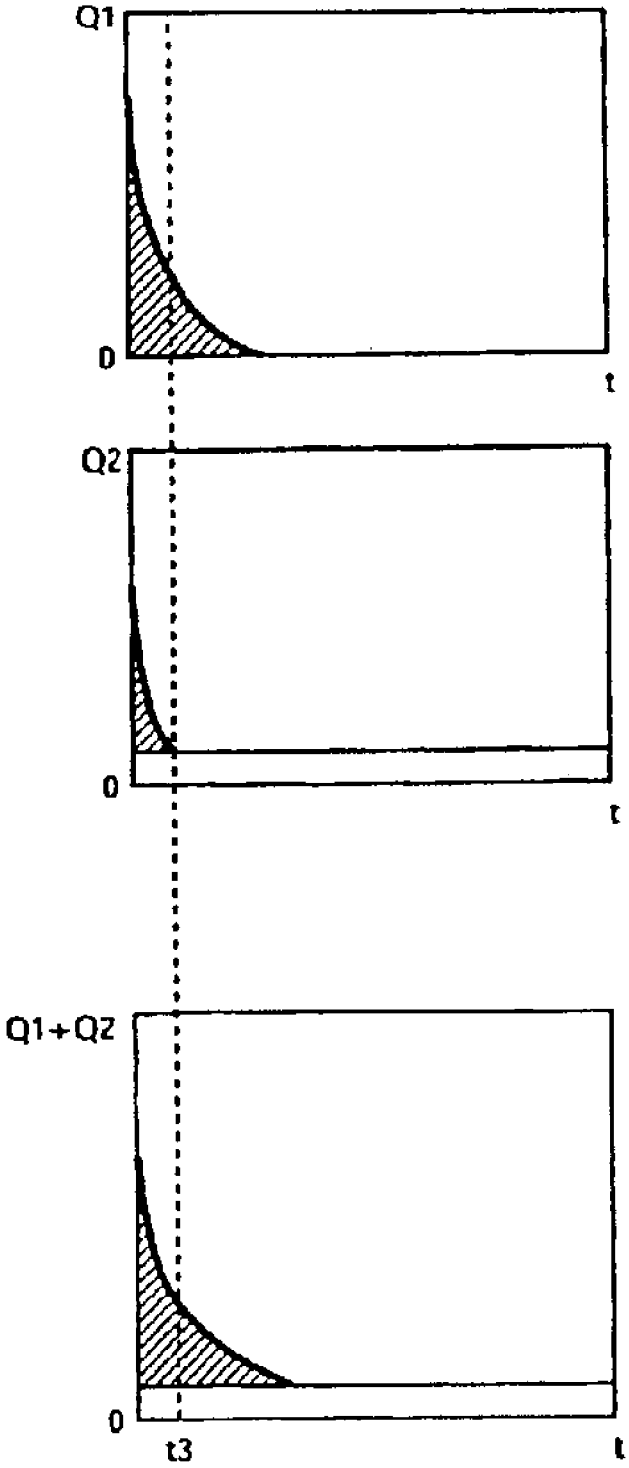
FIG. 5 is a diagram showing variations in amount of charge of the holding capacitor and the parasitic capacitor in FIG. 1 during the read mode shown in FIG. 4.

FIG. 4 is a timing chart showing operations in the read mode. After connecting the data line 6 to the inverted input terminal of the differential amplifier 12, the control circuit 17 raises again the potential GATE of the gate line 5 to the high potential VGH. This causes the switching transistor 4 to turn on. Since the inverted input terminal of the differential amplifier 12 is virtually grounded, the potential VA starts to drop toward the ground potential GND. Following it, as shown in FIG. 5, the charge amount Q1 of the holding capacitor 3 and the charge amount Q2 of the parasitic capacitor 8 also start to decrease.

When the potential VA drops below the threshold value of the drive transistor 2 at time instant t3, the drive transistor 2 turns off so that the drain of the drive transistor 2 is put in a floating state. Accordingly, all the charge of the parasitic capacitor 8 is not discharged, and thus part of the charge remains. Therefore, as shown in FIG. 5, the charge amount Q2 of the parasitic capacitor 8 becomes constant after time instant t3. On the other hand, as shown in FIG. 4, inasmuch as the potential VA continues to drop even after time instant t3, the potential VB drops lower than the ground potential GND due to coupling of the parasitic capacitor 8.

Charge amounts Qr1 and Qr2 that remain in the holding capacitor 3 and the parasitic capacitor 8 according to the foregoing reading are expressed by the following equations (3) and (4), respectively.

$$Qr1=C1(Vra-Vrc) \quad (3)$$

$$Qr2=C2(Vra-Vrb) \quad (4)$$

In the equations (3) and (4), Vra represents the potential VA (=GND) upon the termination of the reading, Vrb the potential VB upon the termination of the reading, and Vrc the potential VC (=GND) upon the termination of the reading.

Detection Mode

Figure 6:
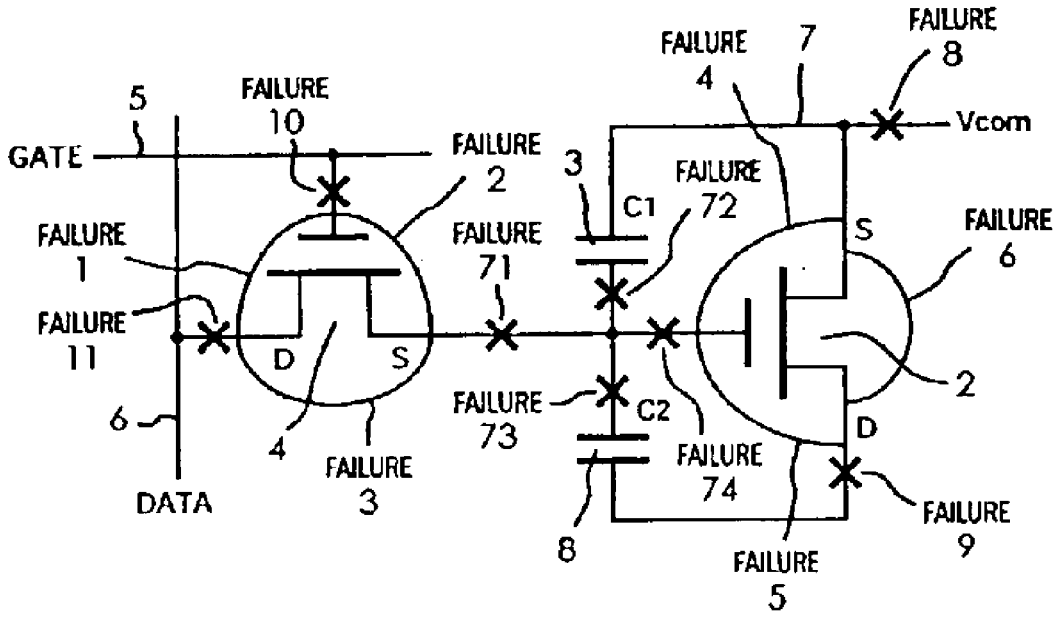
FIG. 6 is a diagram showing failure portions on the organic EL array substrate shown in FIG. 1.
Figure 7:
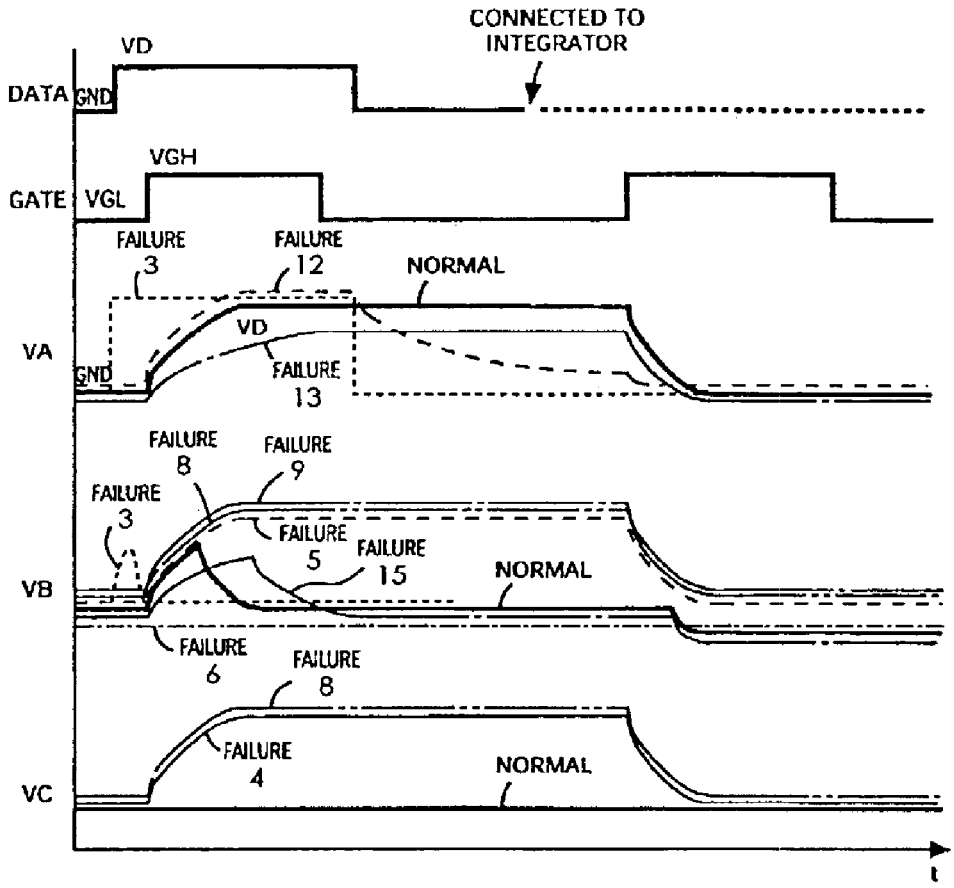
FIG. 7 is a timing chart showing operations in the read and write modes shown in FIGS. 2 and 4 when there are failures on the organic EL array substrate shown in FIG. 1, in comparison with the normal operations.
Figure 8:
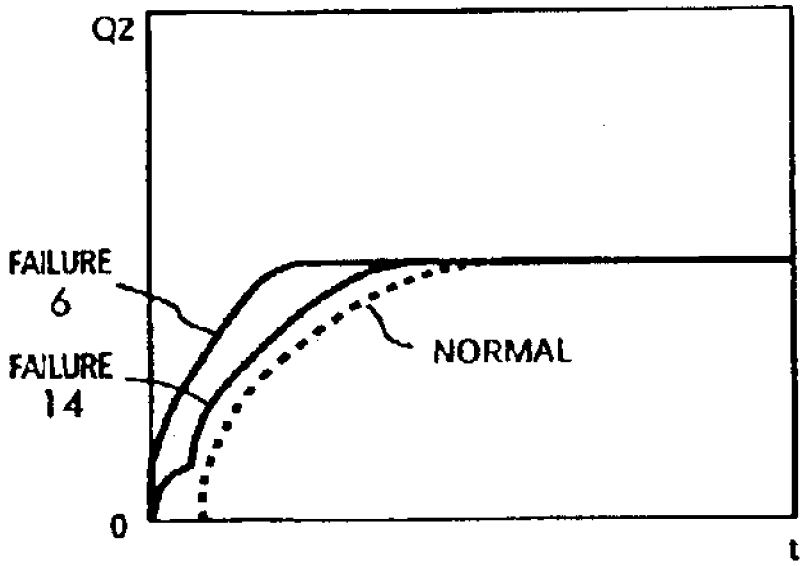
FIG. 8 is a diagram showing variations in amount of charge of the parasitic capacitor in the write mode shown in FIG. 2 when there are failures on the organic EL array substrate shown in FIG. 1, in comparison with the normal variation.
Figure 9:
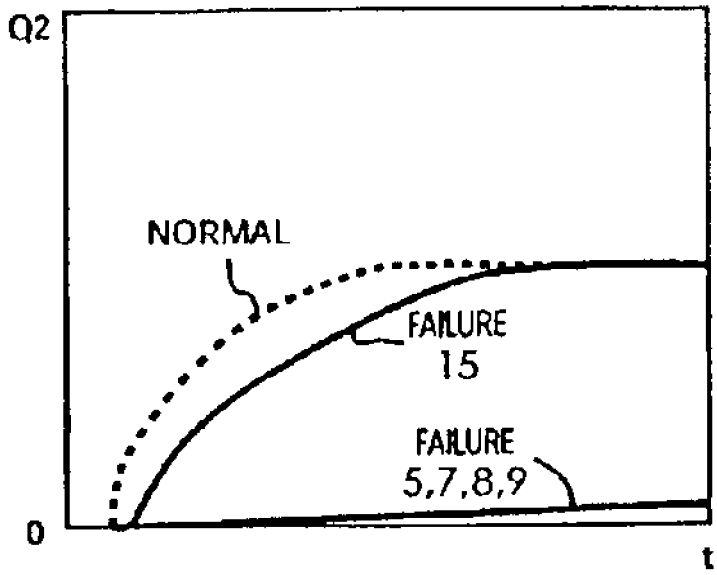
FIG. 9 is a diagram showing variations in amount of charge of the parasitic capacitor in the write mode shown in FIG. 2 when there are failures on the organic EL array substrate shown in FIG. 1, in comparison with the normal variation.

There is a possibility of occurrence of the following failures 1 to 15 on the organic EL array substrate. FIG. 6 shows those failure portions. FIG. 7 is a timing chart showing variations of the potentials VA, VB and VC when those failures occur. FIGS. 8 and 9 show variations of the charge amount Q2 of the parasitic capacitor 8 in the write mode when the failures occur. Hereinbelow, characteristics of the respective failures will be described.

Failure 1: Short Circuit between Gate and Drain of Switching Transistor 4

When a short circuit occurs between the gate and drain of the switching transistor 4, the potential GATE of the gate line 5 is directly given to the data line 6 so that the integrator 10 cannot detect the amount of charge. Therefore, this failure is detected as a cross short circuit between the gate and drain in line defect inspection before pixel defect inspection.

Failure 2: Short Circuit between Gate and Source of Switching Transistor 4

If a short circuit occurs between the gate and source of the switching transistor 4, the potential GATE of the gate line 5 is directly given to the data line 6 like in case of the foregoing failure 1 when the switching transistor 4 turns on. Accordingly, the integrator 10 can not detect the amount of charge. Therefore, this failure is also detected like the failure 1.

Failure 3: Short Circuit between Drain and Source of Switching Transistor 4

When a short circuit occurs between the drain and source of the switching transistor 4, the potential VA becomes equal to the potential DATA of the data line 6. Accordingly, even if the holding capacitor 3 and the parasitic capacitor 8 are charged, the charge therein is always discharged when the potential DATA of the data line 6 returns to the ground potential GND. Therefore, the integrator 10 can not detect the amount of charge.

Failure 4: Short Circuit between Gate and Source of Drive Transistor 2

When a short circuit occurs between the gate and source of the drive transistor 2, the potential VA constantly becomes equal to the potential VC and thus the holding capacitor 3 is not charged.

Failure 5: Short Circuit between Gate and Drain of Drive Transistor 2

When a short circuit occurs between the gate and drain of the drive transistor 2, the potential VA constantly becomes equal to the potential VB and thus the parasitic capacitor 8 is not charged (see FIG. 9).

Failure 6: Short Circuit between Drain and Source of Drive Transistor 2

When a short circuit occurs between the drain and source of the drive transistor 2, the potential VB constantly becomes equal to the potential VC and thus the parasitic capacitor 8 is charged at the same speed with the holding capacitor 3 (see FIG. 8).

Failure 7: Open Circuit at Gate of Drive Transistor 2

When disconnection occurs at a failure 71 in FIG. 6, either of the holding capacitor 3 and the parasitic capacitor 8 is not charged (see FIG. 9). When disconnection occurs at a failure 72 in FIG. 6, the holding capacitor 3 is not charged. When disconnection occurs at a failure 73 in FIG. 6, the parasitic capacitor 8 is not charged (see FIG. 9). When disconnection occurs at a failure 74 in FIG. 6, the drive transistor 2 is not operated and thus the parasitic capacitor 8 is not charged (see FIG. 9).

Failure 8: Open Circuit at Common Line

When the common line is disconnected, the potentials VB and VC both become in floating states and change like the potential VA, so that either of the holding capacitor 3 and the parasitic capacitor 8 is not charged (see FIG. 9).

Failure 9: Open Circuit at Drain of Drive Transistor 2

When disconnection occurs at the drain of the drive transistor 2 (so with a case of no provision of the drive transistor 2), the potential VB becomes in a floating state and changes like the potential VA, the parasitic capacitor 8 is not charged (see FIG. 9).

Failure 10: Open Circuit at Gate of Switching Transistor 4

When disconnection occurs at the gate of the switching transistor 4 (so with a case of no provision of the switching transistor 4), the integrator 10 can not detect the amount of charge.

Failure 11: Open Circuit at Source of Switching Transistor 4

When disconnection occurs at the source of the switching transistor 4, the result is the same as in case of the foregoing failure 10.

Failure 12: OFF Failure of Switching Transistor 4

In case the switching transistor 4 can not be fully turned off, when the potential DATA of the data line 6 returns to the ground potential GND, the holding capacitor 3 and the parasitic capacitor 8 are discharged so that the potential VA drops gradually.

Failure 13: ON Failure of Switching Transistor 4

In case the switching transistor 4 can not be fully turned on, the holding capacitor 3 and the parasitic capacitor 8 are not charged sufficiently. Thus, the rise of the potential VA is delayed.

Failure 14: OFF Failure of Drive Transistor 2

In case the drive transistor 2 cannot be fully turned off, the parasitic capacitor 8 starts to be charged simultaneously when the holding capacitor 3 starts to be charged. Therefore, the parasitic capacitor 8 is charged faster than normal (see FIG. 8).

Failure 15: ON Failure of Drive Transistor 2

In case the drive transistor 2 cannot be fully turned on, a delay time from the start of charging of the holding capacitor 3 to the start of charging of the parasitic capacitor 8 is prolonged. Therefore, a delay occurs with the potential VB becoming equal to the potential VC (see FIG. 9).

According to the conventional inspection method, among the foregoing failures, those failures relating to the drive transistor 2 can not be detected on the organic EL array substrate with no organic EL element formed thereon. On the other hand, according to the inspection method of the present invention, by writing charge into the holding capacitor 3 and the parasitic capacitor 8 and detecting the written charge using the integrator 10, the failures relating to the drive transistor 2 can also be detected.

The integrator 10 detects the total amount of charge (hatched portions in FIG. 5) read from the holding capacitor 3 and the parasitic capacitor 8. A charge amount Q detected by the integrator 10 is expressed by the following equation (5).

$$Q=(Qw1+Qw2)-(Qr1+Qr2)=C1\ (Vwa-Vwc)+C2(Vwa-Vwb)-C1(Vra-Vrc)-C2\ (Vra-Vrb) \quad (5)$$

When Vwc=Vrc and Vra=0 are given in the equation (5), the following equation (6) is obtained.

$$Q=C1(Vwa)+C2(Vwa-Vwb+Vrb) \quad (6)$$

From the equation (6), it is understood that the charge amount Q to be detected is determined by the driving potential VD (=Vwa) and the potential VB (=Vwb or Vrb).

However, in case of the foregoing failures 3 and 4, though Vra=0 is established, Vwc=Vrc is not established, so that the equation (5) is used as it is.

In case of the failures 4, 5 and 7 to 9 relating to the drive transistor 2, the charge amount Q detected by the integrator 10 becomes smaller than normal. Accordingly, the detecting section 19 detects those failures.

In case of the failures 6 and 14 relating to the drive transistor 2, if a write time in the write mode is set shorter than a time necessary for fully charging the holding capacitor 3 and the parasitic capacitor 8, the charge amount Q detected by the integrator 10 becomes greater than normal. Accordingly, the detecting section 19 detects those failures.

In case of the failure 15 relating to the drive transistor 2, if a write time in the write mode is set shorter than a time necessary for fully charging the holding capacitor 3 and the parasitic capacitor 8, the charge amount Q detected by the integrator 10 becomes smaller than normal. Accordingly, the detecting section 19 detects such a failure.

Inspection Method for Whole Organic EL Panel

Figure 10:
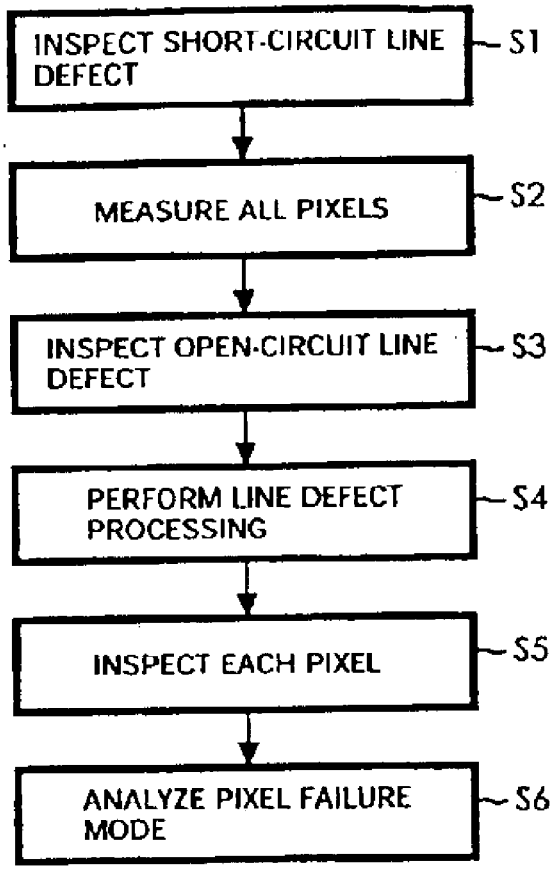
FIG. 10 is a flowchart showing an inspection method for the whole organic EL panel.

The inspection method for each pixel has been described above. This method is used in inspection of the whole organic EL panel. FIG. 10 is a flowchart showing an inspection method for the whole organic EL panel.

First, line-to-line short-circuit failures of the gate lines 5, the data lines 6, the common lines 7 and so forth are inspected (step S1). Specifically, different potentials are given to a line to be inspected and another line. If a short circuit exists therebetween, current flows. By measuring this current, a line-to-line short-circuit failure can be inspected.

Subsequently, amounts of charge are detected with respect to all the pixels according to the foregoing method (step S2). The detected charge amounts are converted to digital values via an A/D converter, so that the charge amount of each pixel is inputted into a personal computer.

Subsequently, open-circuit failures of the gate lines 5 and the data lines 6 are inspected (step S3). Specifically, the charge amounts are detected with respect to several pixels from an end (on the side remote from a connection pad) of each line, using the foregoing method. If the detected charge amount is no greater than a prescribed threshold value, the corresponding line is judged to have an open-circuit failure.

Subsequently, processing is carried out, such as to mend the discovered line defect if possible (step S4).

Figure 11:
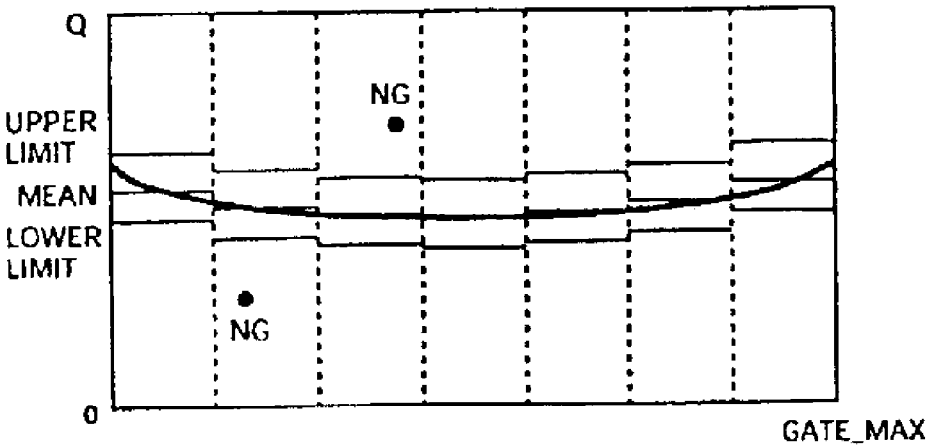
FIG. 11 is a graph in which charge amounts detected for all the pixels are plotted with respect to gate lines in the inspection method shown in FIG. 10.

Subsequently, a failure is inspected with respect to each pixel (step S5). In this event, however, the inspection of a failure per pixel is not implemented with respect to a line for which a line defect has been discovered. For inspecting a failure per pixel, the mean of the detected charge amounts is first calculated. FIG. 11 is a graph in which the charge amounts detected for all the pixels are plotted with respect to the gate lines. The axis of abscissas is divided into a plurality of sections. All the gate lines are classified into a plurality of groups corresponding to the plurality of sections. Each group includes a plurality of gate lines. For each of the sections, the mean of the charge amounts detected with respect to those pixels on the same data line crossing the plurality of gate lines included in the group is calculated. Inasmuch as each data line is connected to one integrator, the charge amounts of all the pixels on the same data line are detected by the same integrator. After calculating the mean per section, it is judged whether or not a pixel has a failure, based on whether or not the charge amount of that pixel falls within a prescribed range centering around the calculated mean.

Finally, a charge amount of each of the pixels is measured by changing a condition such as the control timing of the gate line or the input potential of the data line, thereby to analyze various failure modes (step S6).

Second Embodiment

In the foregoing first embodiment, the potentials VA and VB are indefinite until time instant t1 shown in FIG. 2. If the holding capacitor 3 and the parasitic capacitor 8 are charged in such a state, there is a possibility of occurrence of a difference in charging characteristic among the pixels, so that there is a possibility that the integrator 10 can not stably detect the charge amounts. Further, inasmuch as a time from time instant t1 to time instant t2 is short, there is a possibility that detection of an OFF failure of the drive transistor 2 (the foregoing failure 14) becomes insufficient.

The purpose of the second embodiment described hereinbelow is to provide an inspection method that can stably detect the charge amounts of the holding capacitor 3 and the parasitic capacitor 8 and, in particular, that can securely detect the OFF failure of the drive transistor 2.

Precharge Mode

Figure 12:
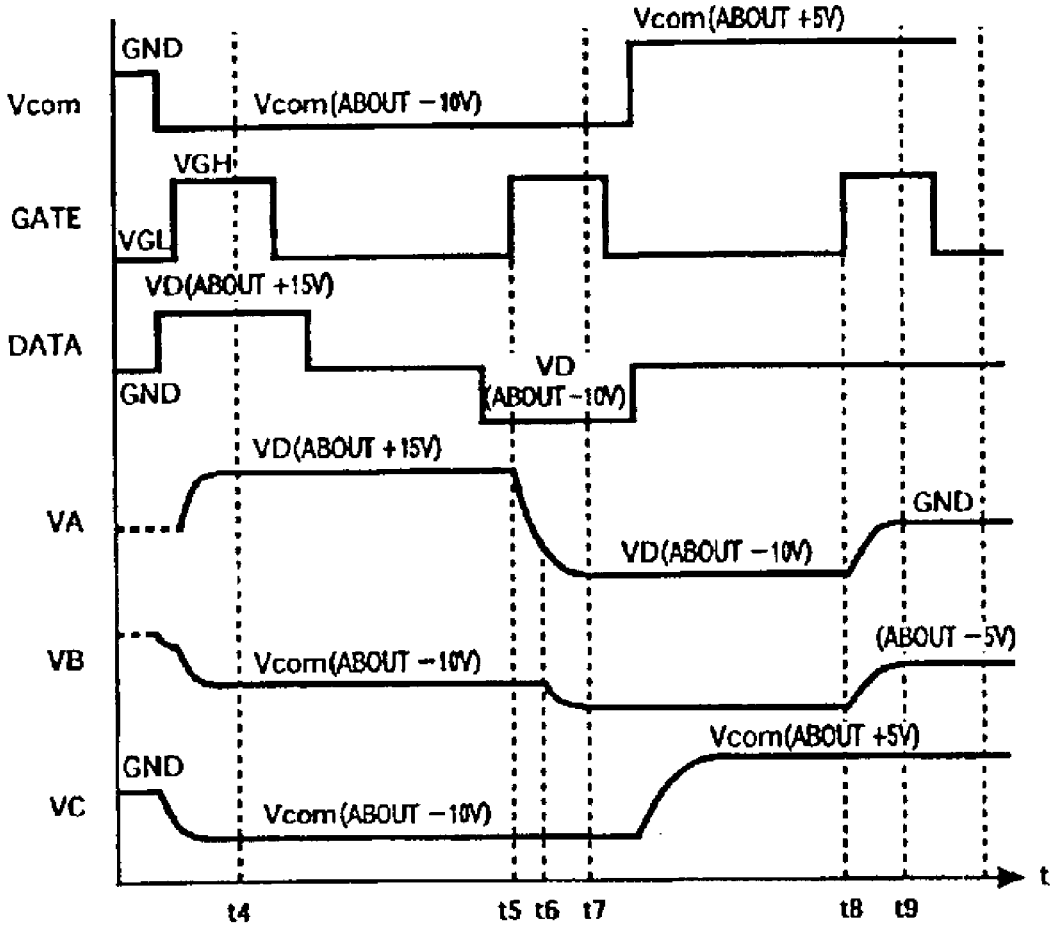
FIG. 12 is a timing chart showing operations in a pre-charge mode of the inspection method according to the second preferred embodiment of the present invention.

The inspection method according to the second embodiment carries out a precharge operation shown in FIG. 12 prior to a write operation. The control circuit 17 shown in FIG. 1 is connected also to the common line 7 and controls also the potential Vcom of the common line 7 according to a later-described method. The control circuit 17 controls the common potential Vcom to about −10V, then to about +5V. The control circuit 17 further controls the potential GATE of the gate line 5 from the low potential VGL to the high potential VGH twice while controlling the common potential Vcom to about −10V, and once while controlling the common potential Vcom to about +5V. The write circuit 18 controls the potential DATA of the data line 6 to about +15V when the potential GATE of the gate line 5 is first controlled to the high potential VGH while the common potential Vcom is controlled to about −10V, and to about −10V when the potential GATE of the gate line 5 is controlled to the high potential VGH for the second time.

At time instant t4, the switching transistor 4 turns on, so that the indefinite potential VA becomes equal to the potential VD (about +15V) of the data line 6. Accordingly, the drive transistor 2 turns on and thus the indefinite potential VB becomes equal to the common potential Vcom (about −10V), i.e. the potential VC.

Subsequently, when the switching transistor 4 turns on at time instant t5, the potential VA starts to drop toward the potential VD (about −10V) of the data line 6. When the potential VA drops blow the threshold value of the drive transistor 2, the drive transistor 2 turns off and thus the potential VB becomes in a floating state. Since the potential VA continues to drop even after time instant t6, the potential VB drops slightly lower than Vcom (about −10V) due to coupling of the parasitic capacitor 8. As a result, the potential VB becomes a negative potential (<−10V) at time instant t7.

Subsequently, when the switching transistor 4 turns on at time instant t8, the potential VA starts to rise toward the potential GND of the data line 6. The potential VB rises slightly due to coupling of the parasitic capacitor 8. As a result, at time instant t9, the potential VA becomes the ground potential GND, the potential VB becomes a negative potential (about −5V), and the potential VC becomes Vcom (about +5V).

As described above, since the potentials VA and VB become definite before writing, the integrator 10 can read the charge written into the holding capacitor 3 and the parasitic capacitor 8 and stably detect the charge amounts thereof. A difference occurs between the potential VB and the potential VC, and this potential difference is reduced with a lapse of time when there is an OFF failure in the drive transistor 2. Therefore, by detecting it at the detecting section 19, the OFF failure of the drive transistor 2 can be securely inspected.

The foregoing precharge operation is performed with respect to all the pixels before successively measuring the charge amount per pixel. In this case, there arises a difference in inspection condition among the pixels due to the order of the measurement, but no problem is raised if a sufficient time is provided before inspecting the first pixel.

Write Mode

Figure 13:
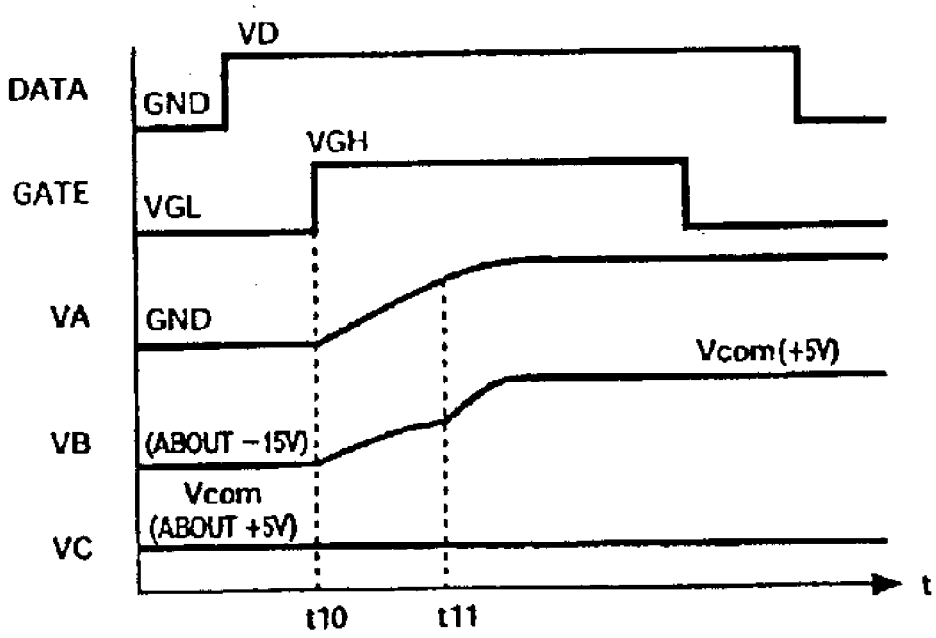
FIG. 13 is a timing chart showing operations in a write mode of the inspection method according to the second preferred embodiment of the present invention.

When writing charge into the holding capacitor 3 and the parasitic capacitor 8, the potential DATA of the data line 6 and the potential GATE of the gate line 5 are changed like in the foregoing first embodiment. However, in this second embodiment, since the potentials VA and VB are definite before writing the charge, the potentials VA and VB change as shown in FIG. 13, which differs from the foregoing first embodiment.

When the switching transistor 4 turns on at time instant t10, the potential VA starts to rise from the ground potential GND toward the potential VD of the data line 6. Following it, the potential VB rises gradually from the negative potential (about −5V) due to coupling of the parasitic capacitor 8. When a difference between the potential VA and the potential VB exceeds the threshold value of the drive transistor 2 at time instant t11, the drive transistor 2 turns on and thus the potential VB rises quickly toward the common potential Vcom. The control circuit 17 returns the potential GATE of the gate line 5 to the low potential VGL before the potential VA reaches the common potential Vcom, thereby to turn off the switching transistor 4.

Figure 14:
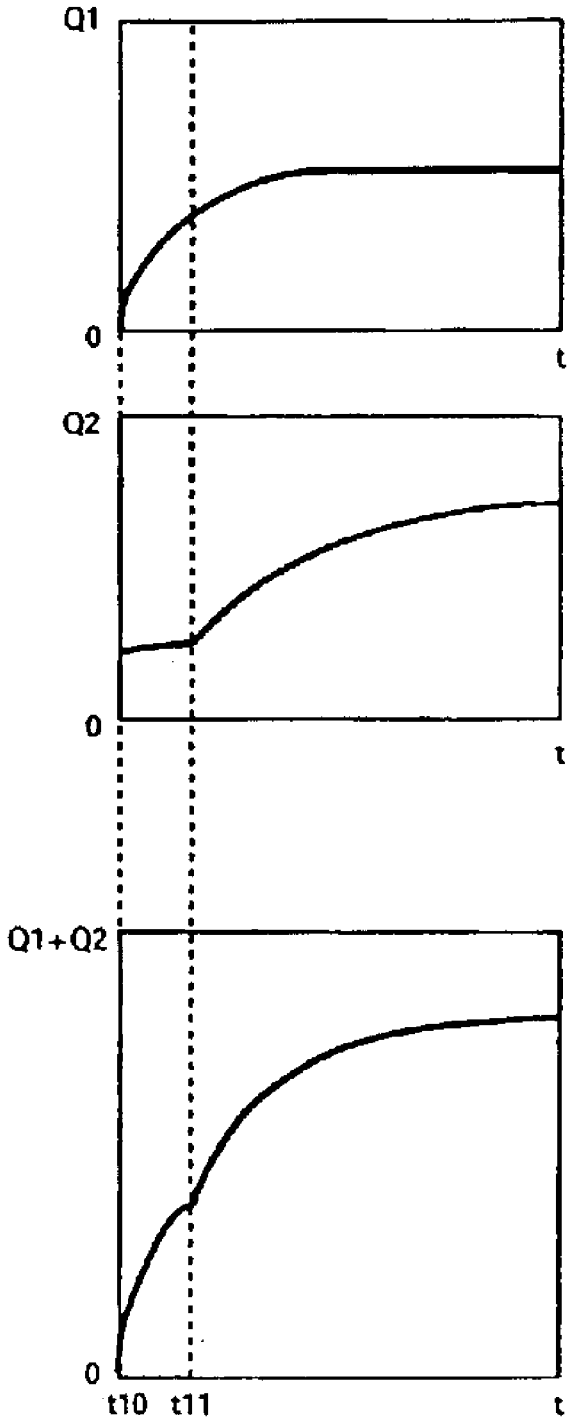
FIG. 14 is a diagram showing variations in amount of charge of the holding capacitor and the parasitic capacitor in FIG. 1 during the write mode shown in FIG. 13.

The charge amount Q1 of the holding capacitor 3, the charge amount Q2 of the parasitic capacitor 8, and the total charge amount Q1+Q2 change as shown in FIG. 14. As opposed to the foregoing first embodiment, the parasitic capacitor 8 has been charged to some extent prior to time instant t11.

Read Mode

Figure 15:
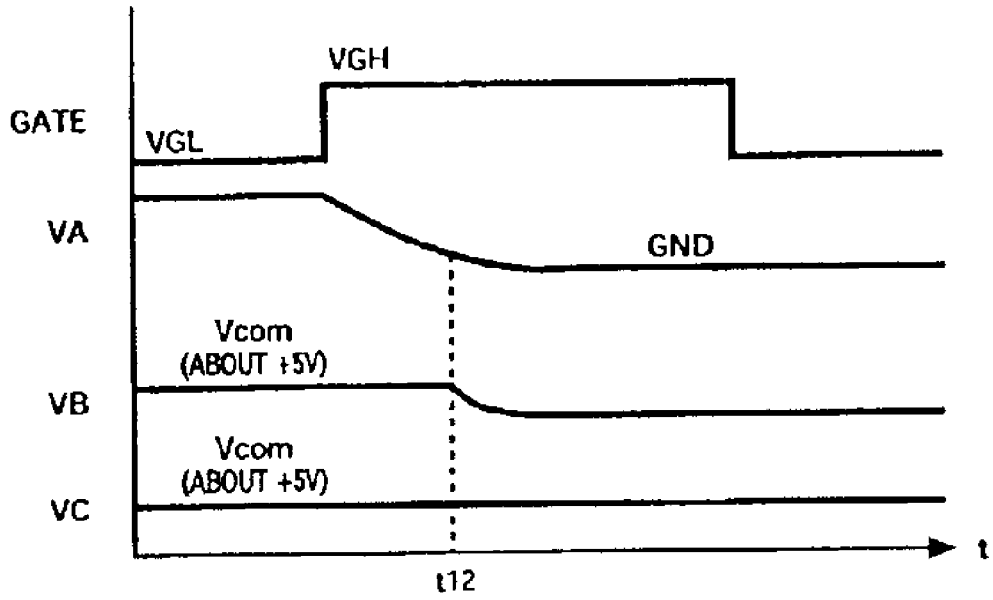
FIG. 15 is a timing chart showing operations in a read mode of the inspection method according to the second preferred embodiment of the present invention.
Figure 16:
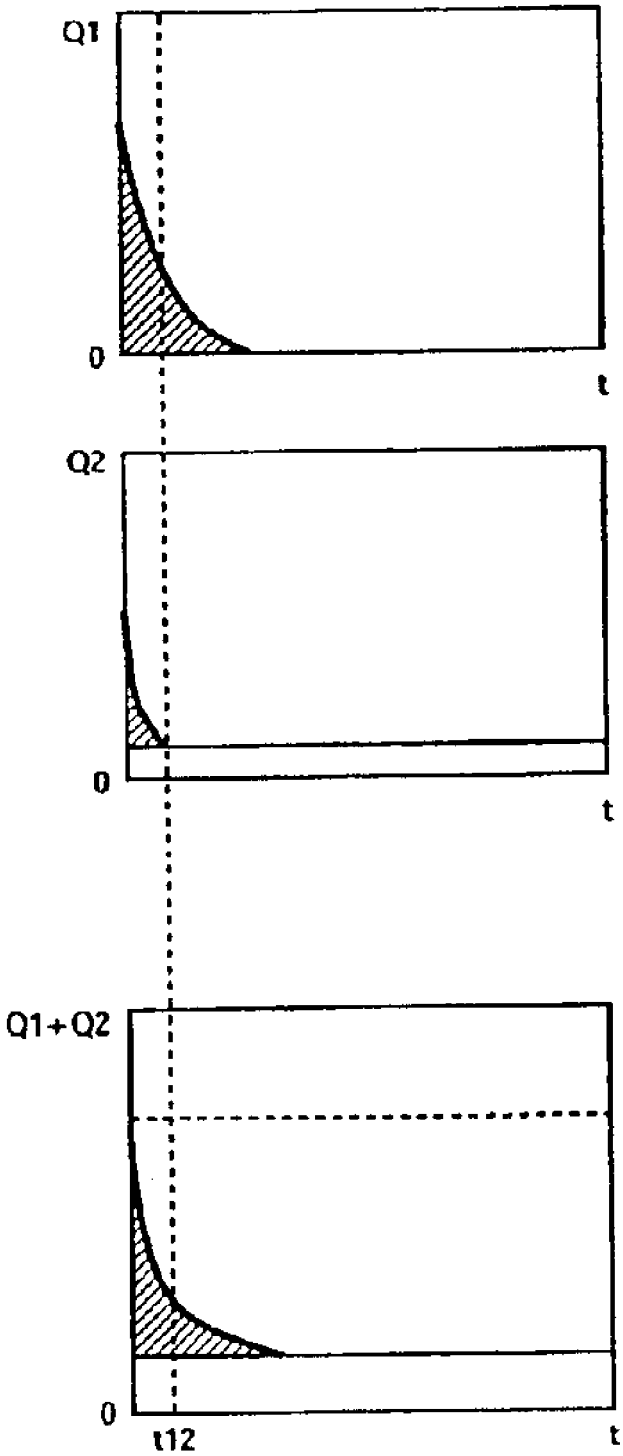
FIG. 16 is a diagram showing variations in amount of charge of the holding capacitor and the parasitic capacitor in FIG. 1 during the read mode shown in FIG. 15.

When reading the charge from the holding capacitor 3 and the parasitic capacitor 8, the control circuit 17 changes the potential GATE of the gate line 5 like in the foregoing first embodiment, as shown in FIG. 15. This causes the potentials VA, VB and VC to change like in the foregoing first embodiment. Accordingly, the charge amount Q1 of the holding capacitor 3, the charge amount Q2 of the parasitic capacitor 8, and the total charge amount Q1+Q2 change as shown in FIG. 16.

Detection Mode

Figure 17:
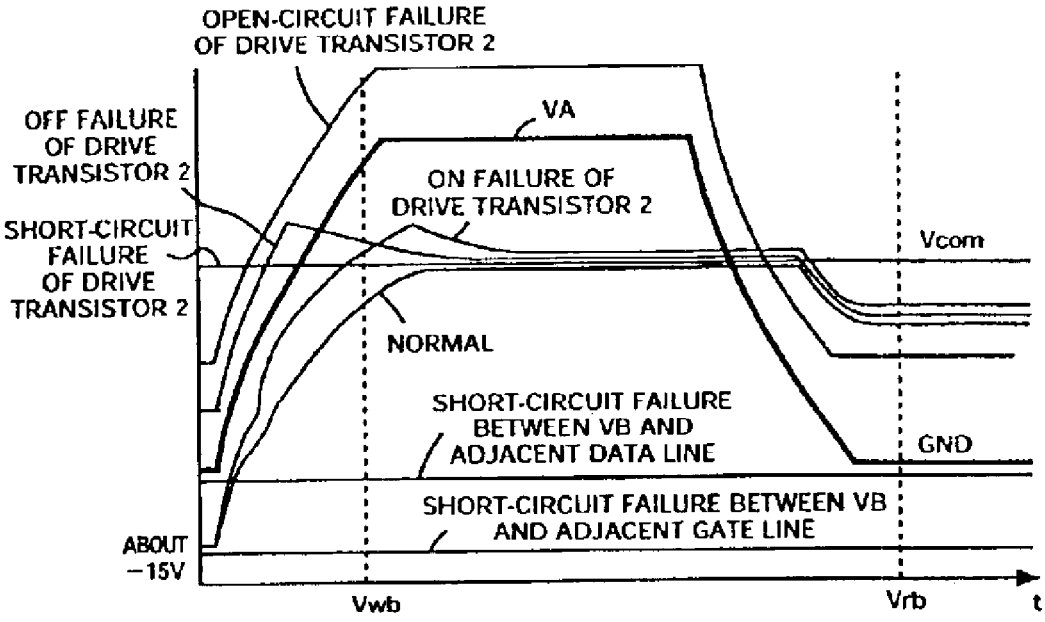
FIG. 17 is a timing chart showing operations in the read and write modes shown in FIGS. 13 and 15 when there are failures on the organic EL array substrate shown in FIG. 1, in comparison with the normal operations.

FIG. 17 is a timing chart showing variations of the potential VB in the write and read modes in connection with the respective failures. On the other hand, a thick line in the figure represents a variation of the potential VA.

A charge amount Q detected by the integrator 10 is expressed by the following equation (7).

$$Q=C1(Vwa)+C2(Vwa-Vwb)-C2(Vra-Vrb) \quad (7)$$

In case of an open-circuit failure of the drive transistor 2, (Vwa−Vwb)=(Vra−Vrb) so that the charge amount of the parasitic capacitor 8 is not detected. Therefore, the charge amount Q to be detected becomes smaller than normal.

In case of a short-circuit failure of the drive transistor 2, Vwb=Vrb. Since Vra=0, C2(Vwa) is detected as the charge amount Q and the charge amount of the holding capacitor 3 is not detected. Therefore, the charge amount Q to be detected becomes smaller than normal.

In case of an OFF failure or ON failure of the drive transistor 2, Vwb becomes higher than normal so that the charge amount Q to be detected becomes smaller than normal.

Figure 18:
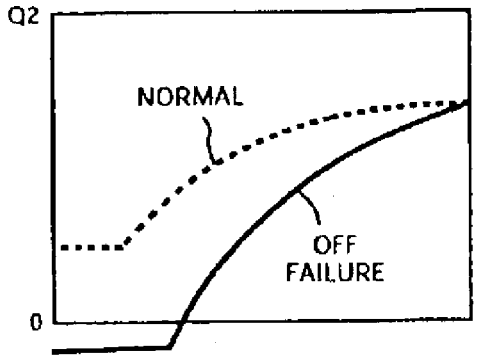
FIG. 18 is a diagram showing a variation in amount of charge of the parasitic capacitor in the write mode shown in FIG. 13 when there is an OFF failure in a drive transistor shown in FIG. 1, in comparison with the normal variation.
Figure 19:
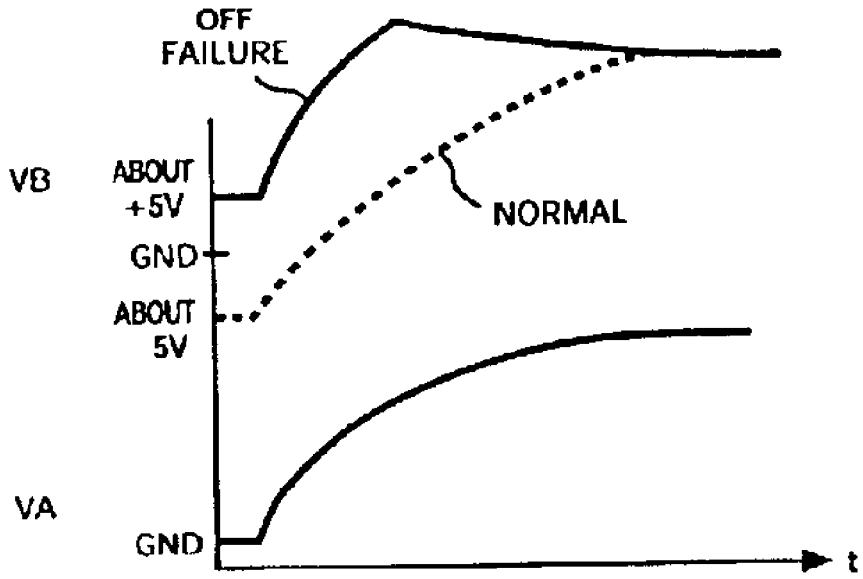
FIG. 19 is a diagram showing variations of potentials VA and VB in FIG. 1 in the case shown in FIG. 18.

When there is an OFF failure in the drive transistor 2, the charge amount Q2 of the parasitic capacitor 8 changes as shown in FIG. 18 in the write mode. In this event, since the drive transistor 2 can not be fully turned off, the potential VB can not keep the negative potential (about −5V), but is raised to the common potential Vcom (about +5V) as shown in FIG. 19. Therefore, the time when the drive transistor 2 turns on is delayed than normal. Accordingly, the potential VB rises following the potential VA and, when the potential VA relative to the potential VC exceeds the threshold value of the drive transistor 2, the drive transistor 2 turns on so that the potential VB drops toward the potential VC.

In case of a short-circuit failure between the drain of the drive transistor 2 and the data line of an adjacent element, or in case of a short-circuit failure between the drain of the drive transistor 2 and the gate line of an adjacent element, Vwb=Vrb. In this event, since Vra=0, C2(Vwa) is detected as the charge amount Q and the charge amount of the holding capacitor 3 is not detected. Therefore, the charge amount Q to be detected becomes smaller than normal.

The preferred embodiments of the present invention have been described above, which, however, are only examples for embodying the present invention. Therefore, the present invention is not limited to the foregoing embodiments, but can be embodied by properly modifying the foregoing embodiments within a range without departing from the gist of the present invention.

What is claimed is:

1. An inspection method for an EL array substrate having a drive transistor with a drain connected to one of electrodes of an EL element, a holding capacitor connected to a gate of said drive transistor, a parasitic capacitor formed between said one of electrodes of the EL element and the gate of said drive transistor, and a switching transistor with a source connected to the gate of said drive transistor, said method comprising:

a writing step of giving a prescribed potential to a drain of said switching transistor, and turning on said switching transistor for a prescribed write time;

a reading step of, after a lapse of a prescribed time from turning-off of said switching transistor, turning on again said switching transistor, and connecting the drain of said switching transistor to a charge amount measuring device; and a detection step of detecting a failure on said EL array substrate based on an output of said charge amount measuring device.

2. An inspection method for an EL array substrate according to claim 1, wherein said detection step comprises a step of determining the failure to be a short-circuit failure between the gate and a source of said drive transistor, a short-circuit failure between the gate and the drain of said drive transistor, or an open-circuit failure of said drive transistor when the output of said charge amount measuring device is smaller than normal.

3. An inspection method for an EL array substrate according to claim 1, wherein said write time is shorter than a time necessary for fully charging said holding capacitor and said parasitic capacitor, and said detection step comprises a step of determining the failure to be a short-circuit failure between the drain and the source of said drive transistor, or an OFF failure of said drive transistor when the output of said charge amount measuring device is greater than normal.

4. An inspection method for an EL array substrate according to claim 1, wherein said write time is shorter than a time necessary for fully charging said holding capacitor and said parasitic capacitor, and said detection step comprises a step of determining the failure to be an ON failure of said drive transistor when the output of said charge amount measuring device is smaller than normal.

5. An inspection method for an EL array substrate according to claim 1, further comprising, before said writing step, a drain precharge step of precharging the drain of said drive transistor to a prescribed potential.

6. An inspection method for an EL array substrate according to claim 5, wherein said drain precharge step comprises a step of giving a prescribed potential to the source of said drive transistor, and turning on said drive transistor.

7. An inspection method for an EL array substrate according to claim 6, wherein said step of turning on said drive transistor comprises a step of giving a prescribed potential to the drain of said switching transistor, and turning on said switching transistor.

8. An inspection method for an EL array substrate according to claim 1, further comprising, before said writing step, a gate precharge step of precharging the gate of said drive transistor to a prescribed potential.

9. An inspection method for an EL array substrate according to claim 8, wherein said gate precharge step gives a prescribed potential to the drain of said switching transistor and turns on said switching transistor.

10. An inspection method for an EL array substrate according to claim 5, wherein said write time is shorter than a time necessary for fully charging said holding capacitor and said parasitic capacitor, and said detection step comprises a step of determining the failure to be an ON failure or OFF failure of said drive transistor when the output of said charge amount measuring device is smaller than normal.

11. An inspection apparatus for an EL array substrate having a drive transistor with a drain connected to one of electrodes of an EL element, a holding capacitor connected to a gate of said drive transistor, a parasitic capacitor formed between said one of electrodes of the EL element and the gate of said drive transistor, and a switching transistor with a source connected to the gate of said drive transistor, said apparatus comprising:

writing means for giving a prescribed potential to a drain of said switching transistor, and turning on said switching transistor for a prescribed write time;

reading means for, after a lapse of a prescribed time from turning-off of said switching transistor, turning on again said switching transistor, and connecting the drain of said switching transistor to a charge amount measuring device; and detection means for detecting a failure on said EL array substrate based on an output of said charge amount measuring device.

12. An inspection apparatus for an EL array substrate according to claim 11, wherein said detection means determines the failure to be a short-circuit failure between the gate and a source of said drive transistor, a short-circuit failure between the gate and the drain of said drive transistor, or an open-circuit failure of said drive transistor when the output of said charge amount measuring device is smaller than normal.

13. An inspection apparatus for an EL array substrate according to claim 11, wherein said write time is shorter than a time necessary for fully charging said holding capacitor and said parasitic capacitor, and said detection means determines the failure to be a short-circuit failure between the drain and the source of said drive transistor, or an OFF failure of said drive transistor when the output of said charge amount measuring device is greater than normal.

14. An inspection apparatus for an EL array substrate according to claim 11, wherein said write time is shorter than a time necessary for fully charging said holding capacitor and said parasitic capacitor, and said detection means determines the failure to be an ON failure of said drive transistor when the output of said charge amount measuring device is smaller than normal.

15. An inspection apparatus for an EL array substrate according to claim 11, further comprising drain precharge means for precharging the drain of said drive transistor to a prescribed potential before said writing means operates.

16. An inspection apparatus for an EL array substrate according to claim 15, wherein said drain precharge means gives a prescribed potential to the source of said drive transistor and turns on said drive transistor.

17. An inspection apparatus for an EL array substrate according to claim 16, wherein said drain precharge means gives a prescribed potential to the drain of said switching transistor and turns on said switching transistor for turning on said drive transistor.

18. An inspection apparatus for an EL array substrate according to claim 11, further comprising gate precharge means for precharging the gate of said drive transistor to a prescribed potential before said writing means operates.

19. An inspection apparatus for an EL array substrate according to claim 18, wherein said gate precharge means gives a prescribed potential to the drain of said switching transistor and turns on said switching transistor.

20. An inspection apparatus for an EL array substrate according to claim 15, wherein said write time is shorter than a time necessary for fully charging said holding capacitor and said parasitic capacitor, and said detection means determines the failure to be an ON failure or OFF failure of said drive transistor when the output of said charge amount measuring device is smaller than normal.

* * * * *